US010920393B2

(12) United States Patent
Hren et al.

(10) Patent No.: US 10,920,393 B2
(45) Date of Patent: Feb. 16, 2021

(54) ROPE SHOVEL WITH NON-LINEAR DIGGING ASSEMBLY

(71) Applicant: Joy Global Surface Mining Inc, Milwaukee, WI (US)

(72) Inventors: William J. Hren, Wauwatosa, WI (US); Nicholas R. Voelz, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 383 days.

(21) Appl. No.: 15/481,995

(22) Filed: Apr. 7, 2017

(65) Prior Publication Data

US 2017/0292242 A1 Oct. 12, 2017

Related U.S. Application Data

(60) Provisional application No. 62/320,237, filed on Apr. 8, 2016.

(51) Int. Cl.
*E02F 3/40* (2006.01)
*E02F 3/407* (2006.01)
(Continued)

(52) U.S. Cl.
CPC ..... *E02F 3/401* (2013.01); *E02F 3/308* (2013.01); *E02F 3/38* (2013.01); *E02F 3/4075* (2013.01); *E02F 3/46* (2013.01)

(58) Field of Classification Search
CPC ... E02F 3/30; E02F 3/304; E02F 3/308; E02F 3/38; E02F 3/40; E02F 3/401; E02F 3/3677
See application file for complete search history.

(56) References Cited

U.S. PATENT DOCUMENTS 649,244 A * 5/1900 Heslesaeter ..... E02F 3/30 414/691
895,459 A * 8/1908 Heslesaeter ..... E02F 3/30 414/566
(Continued)

FOREIGN PATENT DOCUMENTS

CA 2141164 4/1996
CA 2333835 8/2001
(Continued)

OTHER PUBLICATIONS

Office Action issued by the Chinese National Intellectual Property Administration for Application No. 201710224014.5 dated Jul. 10, 2020 (19 pages including English summary).

*Primary Examiner* — Jessica H Lutz
(74) *Attorney, Agent, or Firm* — Michael Best & Friedrich LLP

(57) ABSTRACT

A mining machine includes a frame, a boom, an elongated member supported by a pivot element for movement relative to the boom, and a digging attachment. The boom includes a first end coupled to the frame and a second end opposite the first end. The pivot element is positioned between the first end and the second end of the boom. The hoist rope includes a portion extending over the second end of the boom. The member includes a first end, a second end, a first portion proximate the first end of the member, and a second portion positioned between the first portion and the second end of the member. At least a portion of the second portion is oriented at an angle relative to the first portion. The digging attachment is coupled to the second end of the member and is supported by the hoist rope.

26 Claims, 16 Drawing Sheets

(51) Int. Cl.

| | |
|---|---|
| ***E02F 3/46*** | (2006.01) |
| ***E02F 3/30*** | (2006.01) |
| ***E02F 3/38*** | (2006.01) |

(56) References Cited

U.S. PATENT DOCUMENTS

| | | | | | |
|---|---|---|---|---|---|
| 993,059 | A * | 5/1911 | Hale | E02F 3/30 | 414/691 |
| 1,210,194 | A * | 12/1916 | Moynihan | E02F 3/304 | 414/690 |
| 1,457,301 | A | 6/1923 | Ferris | | |
| 1,599,630 | A | 9/1926 | Bager et al. | | |
| 1,769,991 | A | 7/1930 | Fundom | | |
| 2,211,783 | A * | 8/1940 | Knox | E02F 3/304 | 414/722 |
| 3,508,674 | A * | 4/1970 | Schneider | E02F 3/3604 | 414/719 |
| 3,580,405 | A | 5/1971 | Siegel et al. | | |
| 5,469,647 | A | 11/1995 | Profio | | |
| 6,314,667 | B1 | 11/2001 | Rife et al. | | |
| 6,434,862 | B1 | 8/2002 | Hren | | |
| 2003/0191570 | A1 | 10/2003 | Rowlands et al. | | |
| 2005/0150141 | A1 | 7/2005 | Suzik et al. | | |
| 2007/0266601 | A1 | 11/2007 | Claxton | | |
| 2009/0067972 | A1* | 3/2009 | Wurster | E02F 3/627 | 414/722 |
| 2012/0195730 | A1* | 8/2012 | Hren | E02F 3/304 | 414/723 |
| 2013/0259621 | A1* | 10/2013 | Wurster | B66D 1/22 | 414/685 |
| 2014/0227071 | A1* | 8/2014 | Maki | E21C 47/00 | 414/685 |
| 2018/0179725 | A1* | 6/2018 | Gross | E02F 3/308 | |

FOREIGN PATENT DOCUMENTS

| | | | |
|---|---|---|---|
| CN | 86204530 | | 12/1987 |
| CN | 2866627 | | 2/2007 |
| CN | 101387115 | A | 3/2009 |
| CN | 102628285 | A | 8/2012 |
| CN | 103362158 | A | 10/2013 |
| CN | 104379842 | A | 2/2015 |
| CN | 207079647 | U | 3/2018 |

* cited by examiner

ROPE SHOVEL WITH NON-LINEAR DIGGING ASSEMBLY

CROSS-REFERENCE TO RELATED APPLICATION

This application claims the benefit of prior-filed, U.S. Provisional Patent Application No. 62/320,237, filed Apr. 8, 2016, the entire contents of which are incorporated by reference.

BACKGROUND

The present disclosure relates to an industrial machine, in particular to a digging assembly for a rope shovel.

Industrial machines such as rope shovels, draglines, etc., perform digging operations to excavate and remove material from a bank. Rope shovels typically include a boom, a handle movably coupled to the boom and supporting a digging attachment (e.g., a dipper), and a pulley or boom sheave supported on the boom. A hoist rope extends over the boom sheave and supports the digging attachment to raise and lower the attachment.

SUMMARY

In one aspect, a mining machine includes a frame, a boom, a pivot element, a hoist rope, an elongated member supported by the pivot element for movement relative to the boom, and a digging attachment. The boom includes a first end and a second end opposite the first end, and the first end is coupled to the frame. The pivot element is positioned between the first end and the second end of the boom. The hoist rope includes a portion extending over the second end of the boom. The member includes a first end, a second end, a first portion proximate the first end of the member, and a second portion positioned between the first portion and the second end of the member. At least a portion of the second portion is oriented at an angle relative to the first portion. The digging attachment is coupled to the second end of the member and is supported by the hoist rope.

In another aspect, a digging assembly is provided for a rope shovel. The rope shovel includes a boom having a first end and a second end, a pivot element positioned between the first end and the second end of the boom, and a hoist rope extending over the second end of the boom. The digging assembly includes a dipper configured to be supported by the hoist rope, and an elongated handle configured to be supported by the pivot element for movement relative to the boom. The handle includes a first end, a second end coupled to the dipper, a first portion proximate the first end of the handle, and a second portion positioned between the first portion and the second end of the handle. At least a portion of the second portion is oriented at an acute angle relative to the first portion.

In yet another aspect, a digging assembly is provided for a rope shovel. The rope shovel includes a boom having a first end and a second end, a pivot element positioned between the first end and the second end, and a hoist rope extending over the second end. The digging assembly includes a dipper configured to be supported by the hoist rope, and an elongated handle configured to be supported by the pivot element for movement relative to the boom. The handle includes a first end, a second end coupled to the dipper, and a centerline axis extending between the first end and the second end of the handle. The handle defines an axial length extending between the first end and the second end of the handle and projected onto a direction extending linearly between the first end and the second end of the handle. The handle further defines a profile extending between the first end and the second end of the handle along the centerline axis, and the profile defining a profile length greater than the axial length.

Other aspects will become apparent by consideration of the detailed description and accompanying drawings.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or fluid connections or couplings, whether direct or indirect. Also, electronic communications and notifications may be performed using any known means including direct connections, wireless connections, etc.

DETAILED DESCRIPTION

Figure 1:
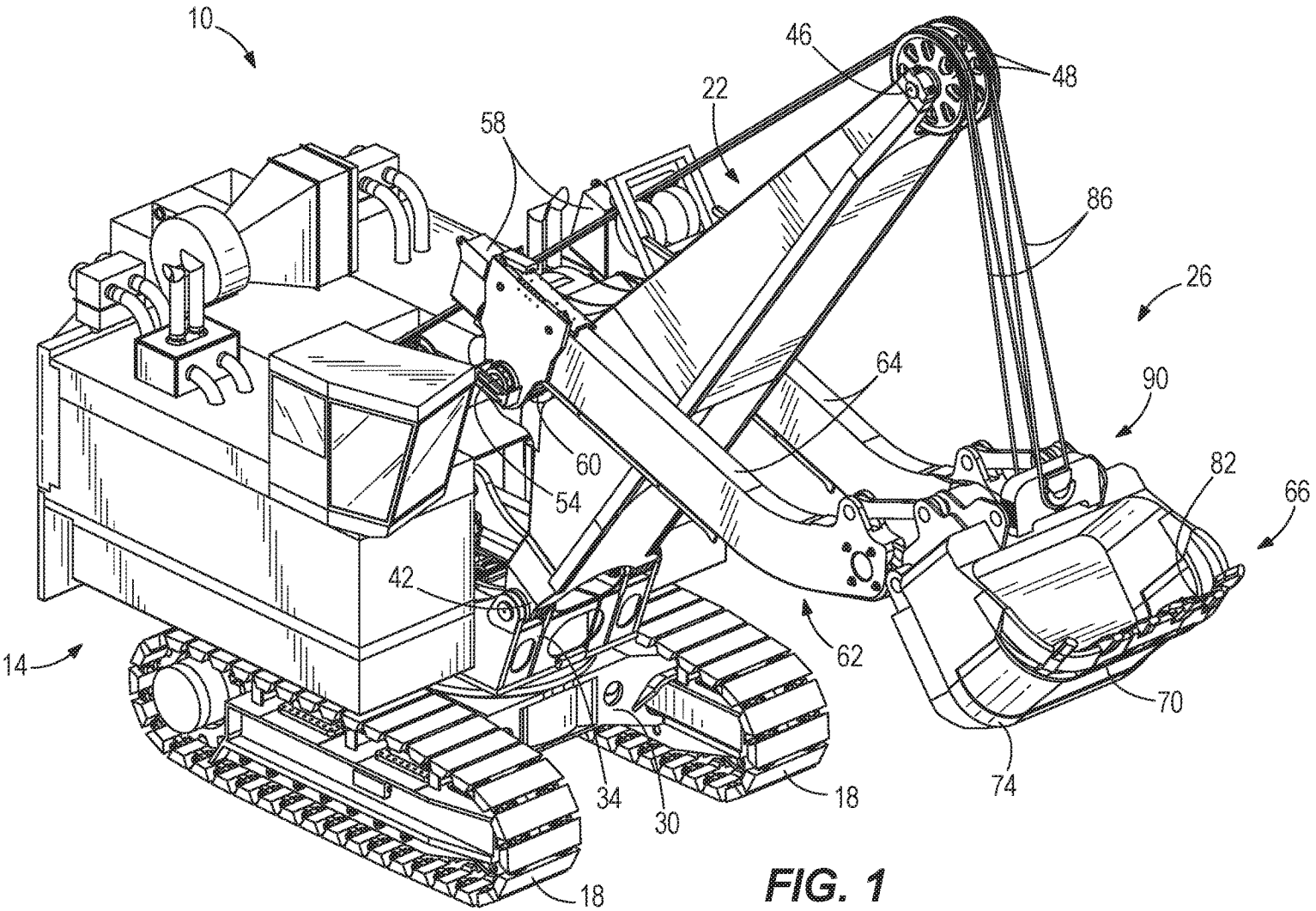
FIG. 1 is a perspective view of a rope shovel.
Figure 3:
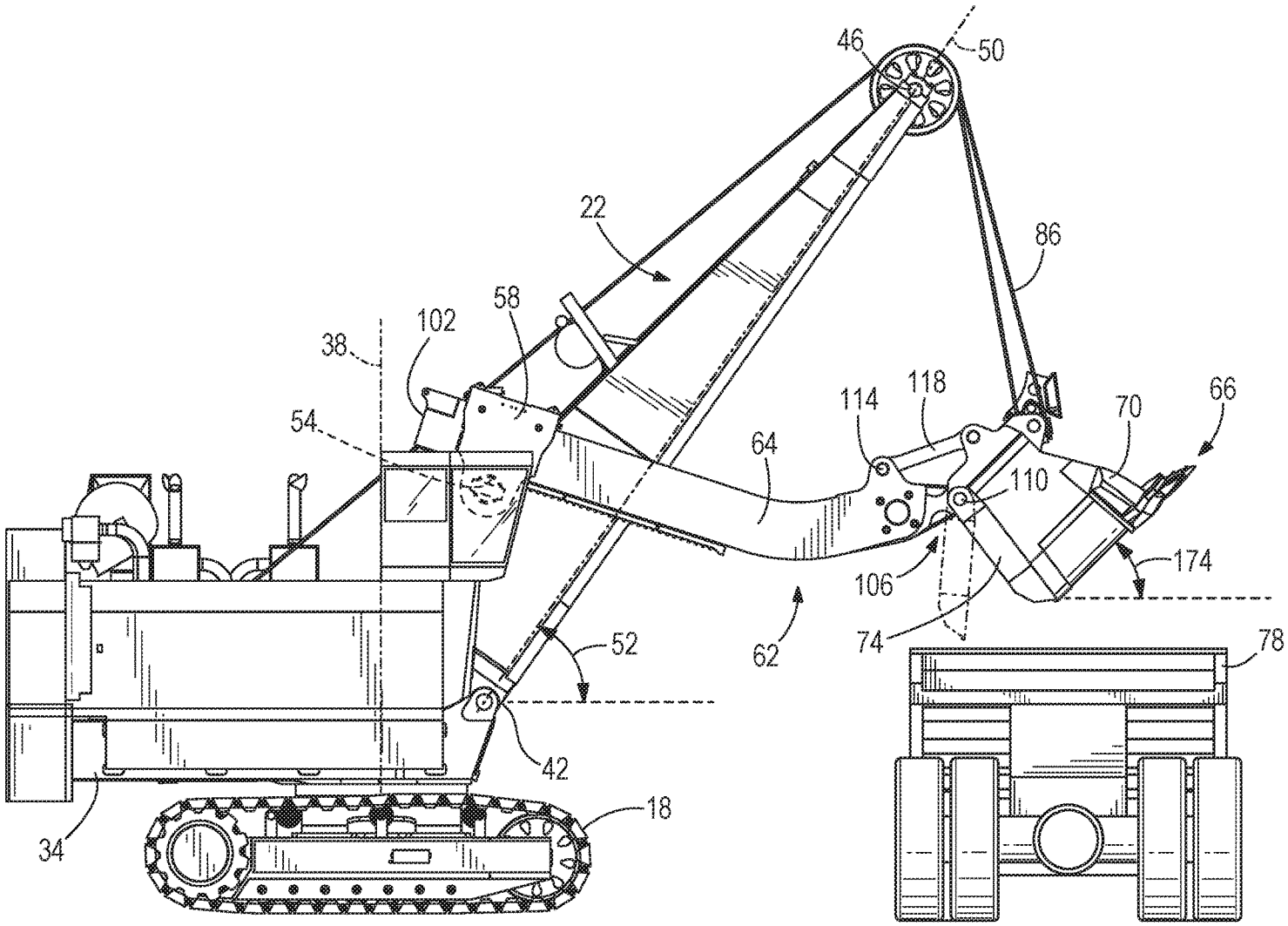
FIG. 3 is a side view of the shovel and the haul vehicle of FIG. 2.

Although the subject matter described herein can be applied to, performed by, or used in conjunction with a variety of industrial machines, embodiments described herein are described with respect to an electric rope or power shovel, such as the rope shovel 10 shown in FIG. 1. The shovel 10 includes a mobile base 14, a drive mechanism or tracks 18 for supporting the base 14, a boom 22, and a digging assembly 26. In the illustrated embodiment, the mobile base 14 includes a lower portion 30 coupled to the tracks 18 and an upper portion or rotating frame 34 that is rotatable relative to the lower portion 30. The rotating frame 34 may be rotatable through 360 degrees about an axis of rotation 38 (FIG. 3). The axis of rotation 38 is substantially perpendicular to a plane defined by the base 14 and generally corresponds to a grade of the ground or support surface.

The boom 22 includes a first or lower end 42 (sometimes referred to as a boom foot) and a second or upper end 46 (sometimes referred to as a boom point). Boom sheaves 48 are coupled to the boom 22 adjacent the upper end 46. The lower end 42 is coupled to the rotating frame 34. In the illustrated embodiment, the boom 22 is supported relative to the rotating frame 34 by a support member (not shown). The support member may be similar to the strut described in U.S. Publication No. 2014/0037414, published Feb. 6, 2014, the entire contents of which are hereby incorporated by reference. The support member provides reaction forces in both tension and compression load conditions to maintain the position of the boom 22 relative to the base 14, within a predetermined range. In other embodiments, the boom 22 may be supported relative to the base 14 by a gantry structure including one or more tension cables.

As shown in FIG. 3, a boom axis 50 extends between the lower end 42 of the boom 22 and the upper end 46, and the boom 22 is supported at a boom angle 52 relative to the rotating frame 34. In the illustrated embodiment, the boom axis 50 is oriented relative to a plane of the rotating frame 34 at a boom angle 52 of approximately 55 degrees. In other embodiments, the boom angle 52 is between approximately 45 degrees and approximately 55 degrees. In some embodiments, the boom angle 52 is approximately 50 degrees. In some embodiments, the boom angle 52 is approximately 45 degrees.

In the illustrated embodiment, a shipper shaft 54 extends transversely through the boom 22. The shipper shaft 54 is positioned between the lower end 42 and the upper end 46 of the boom 22. The shipper shaft 54 supports a pair of saddle blocks 58, and each saddle block 58 is positioned on one side of the boom 22. The shipper shaft 54 also includes a pinion gear 60. The rotation of each pinion gear 60 may be driven by a crowd drive unit (not shown).

The digging assembly 26 includes an elongated member or handle 62 and an attachment or dipper 66 coupled to the handle 62. In the illustrated embodiment, the handle 62 includes a pair of parallel arms 64, and each arm 64 extends along one side of the boom 22 such that the boom 22 is positioned between the arms 64. Each arm 64 extends through one of the saddle blocks 58. The saddle blocks 58 are pivotable relative to the boom 22 about the pinion gear 60, and the arms 64 are extendable and retractable relative to the saddle blocks 58 based on the rotation of the pinion gear 60 and the engagement with a rack 132 (FIG. 4) positioned on each arm 64. As a result, the handle 62 is supported for rotational movement relative to the boom 22 and translational movement relative to the boom 22.

In some embodiments, the attachment is a dipper 66; in other embodiments, the attachment may be a bucket (e.g., a clamshell bucket). The dipper 66 includes a body 70 and a door 74 pivotably coupled to a lower portion of the body 70. When the dipper 66 is positioned over a bed of a haul vehicle (e.g., a truck 78—FIGS. 2 and 3), the door 74 may be opened (FIG. 3) to release or dump the contents of the dipper 66 into the bed. The door 74 may be opened using a conventional latch mechanism that is remotely actuated to permit the door 74 to swing open under the weight of the material in the dipper. The door 74 may be automatically re-latched as the dipper 66 is brought back into a tucked position adjacent a base of the boom 22. The body 70 includes a digging edge 82 proximate a material receiving opening for penetrating and excavating a bank of material (not shown).

Figure 2:
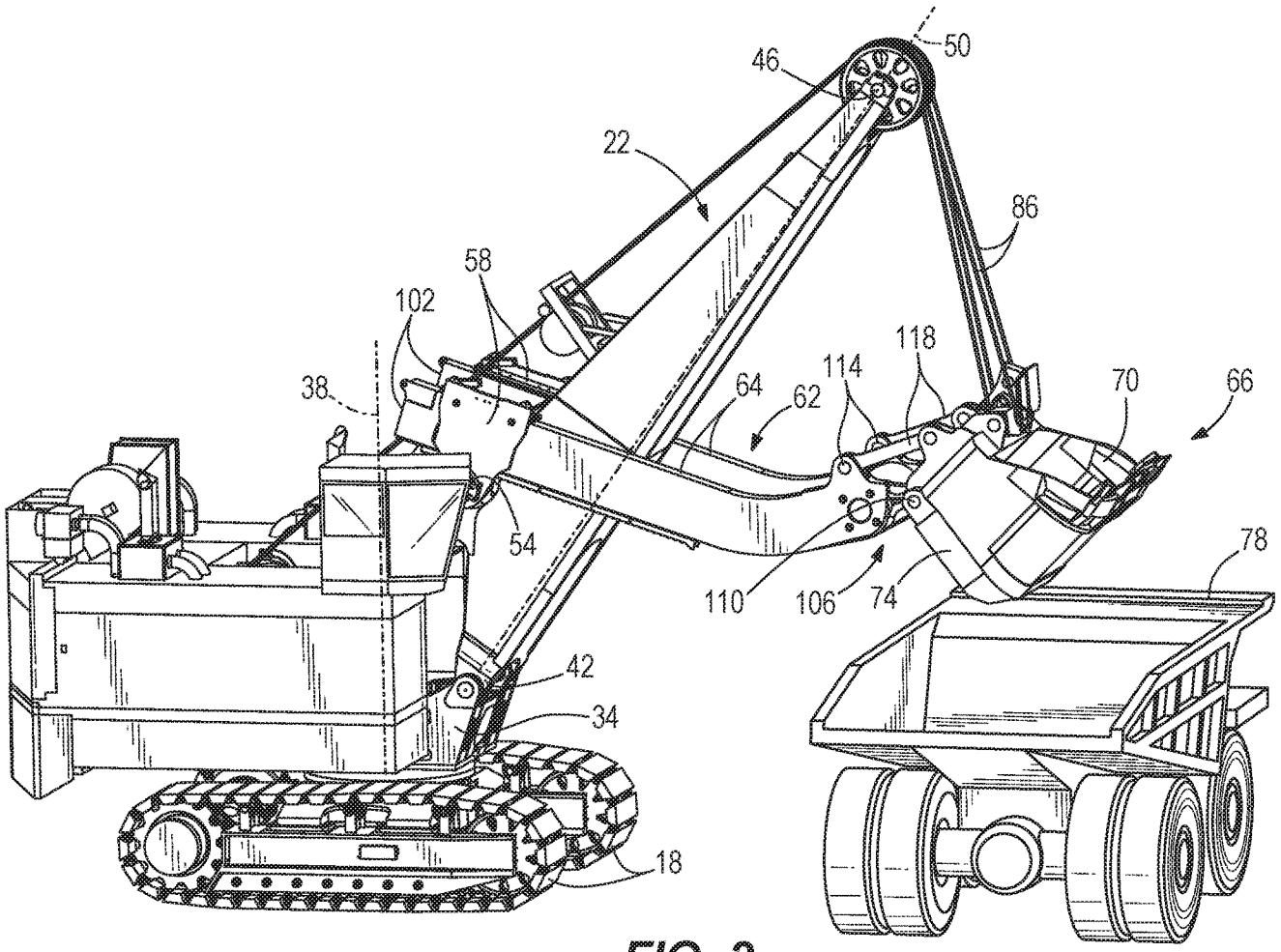
FIG. 2 is a perspective view of a portion of a shovel and a haul vehicle.

As shown in FIGS. 2 and 3, the handle 62 includes a first end 102 and a second end 106. Each arm 64 of the handle 62 includes a first or lower coupling joint 110 adjacent the second end 106 and a second or upper coupling joint 114. The dipper 66 is directly coupled to the second end 106 at the lower coupling joint 110. In the illustrated embodiment, the dipper 66 is secured against movement relative to the handle 62. A pitch brace 118 is coupled between an upper portion of a rear wall of the dipper 66 and the upper coupling joint 114. In some embodiments, the length of the pitch brace 118 may be adjusted to provide a desired dipper pitch relative to the handle 62.

The shovel 10 further includes hoist ropes 86 extending over the sheave 48 and supporting the dipper 66. The hoist ropes 86 may be secured to a hoist drum (not shown) supported on the base 14. In the illustrated embodiment, a bail assembly 90 is coupled to the dipper 66, and the hoist ropes 86 are coupled to the bail assembly 90 to support the dipper 66. A hoist drive unit (not shown) may control the rotation of the hoist drum such that the dipper 66 is raised as the hoist ropes 86 are reeled in, and the dipper 66 is lowered as the hoist ropes 86 are unwound from the hoist drum.

A power source may provide power to the hoist drive unit (not shown) for driving the hoist drum, to one or more crowd drive units (not shown) for driving each pinion gear 60, and one or more swing drive units (not shown) for rotating the rotating frame 34. In the illustrated embodiment, these drive units and other components are electrically driven; in other embodiments, the drive units and other components are hydraulically driven. Each of the crowd, hoist, and swing drive units can be operated by its own motor controller or may be driven in response to control signals from a controller. The controller may be electrically and/or communicatively connected to a variety of modules or components of the shovel 10. For example, the controller is connected to one or more sensors, a user interface, one or more hoist drive units, one or more crowd drive units, one or more swing drive units, etc. (these elements are not shown in the drawings). The controller includes combinations of hardware and software including, among other things, a processing unit (e.g., a microprocessor, a microcontroller, or another suitable programmable device), a memory, input units, and output units (not shown). These components may transmit signals operable to, among other things, control operation of the shovel 10; control the positions of the boom 22, the dipper handle 62, and the dipper 66; and to monitor the operation of the shovel 10. The sensors may include, among other things, position sensors, velocity sensors, speed sensors, acceleration sensors, an inclinometer, one or more motor field modules, etc. The controller can monitor and/or control, among others, the digging, dumping, hoisting, crowding, and swinging operations of the shovel 10.

Figure 4:
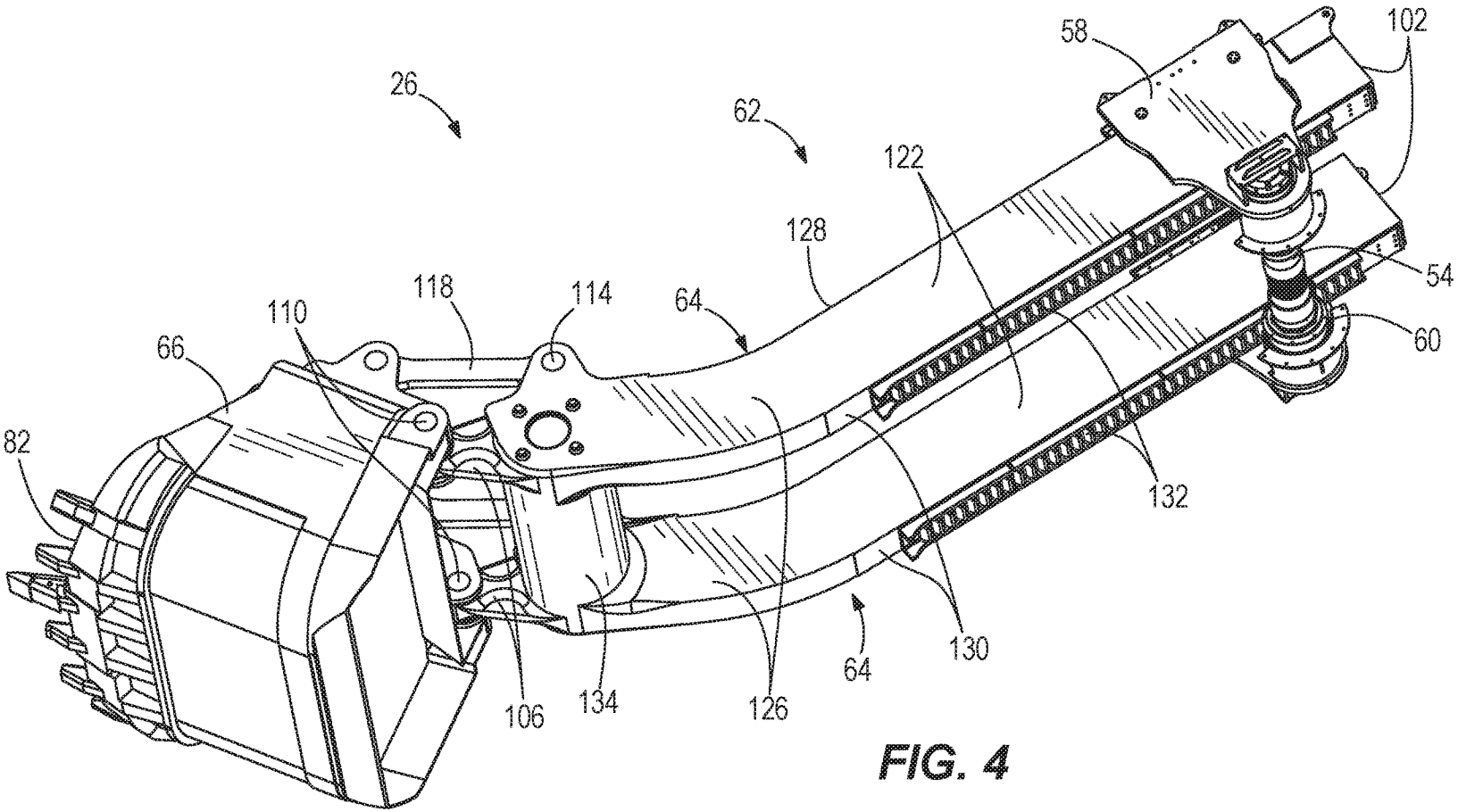
FIG. 4 is a perspective view of a digging assembly.
Figure 5:
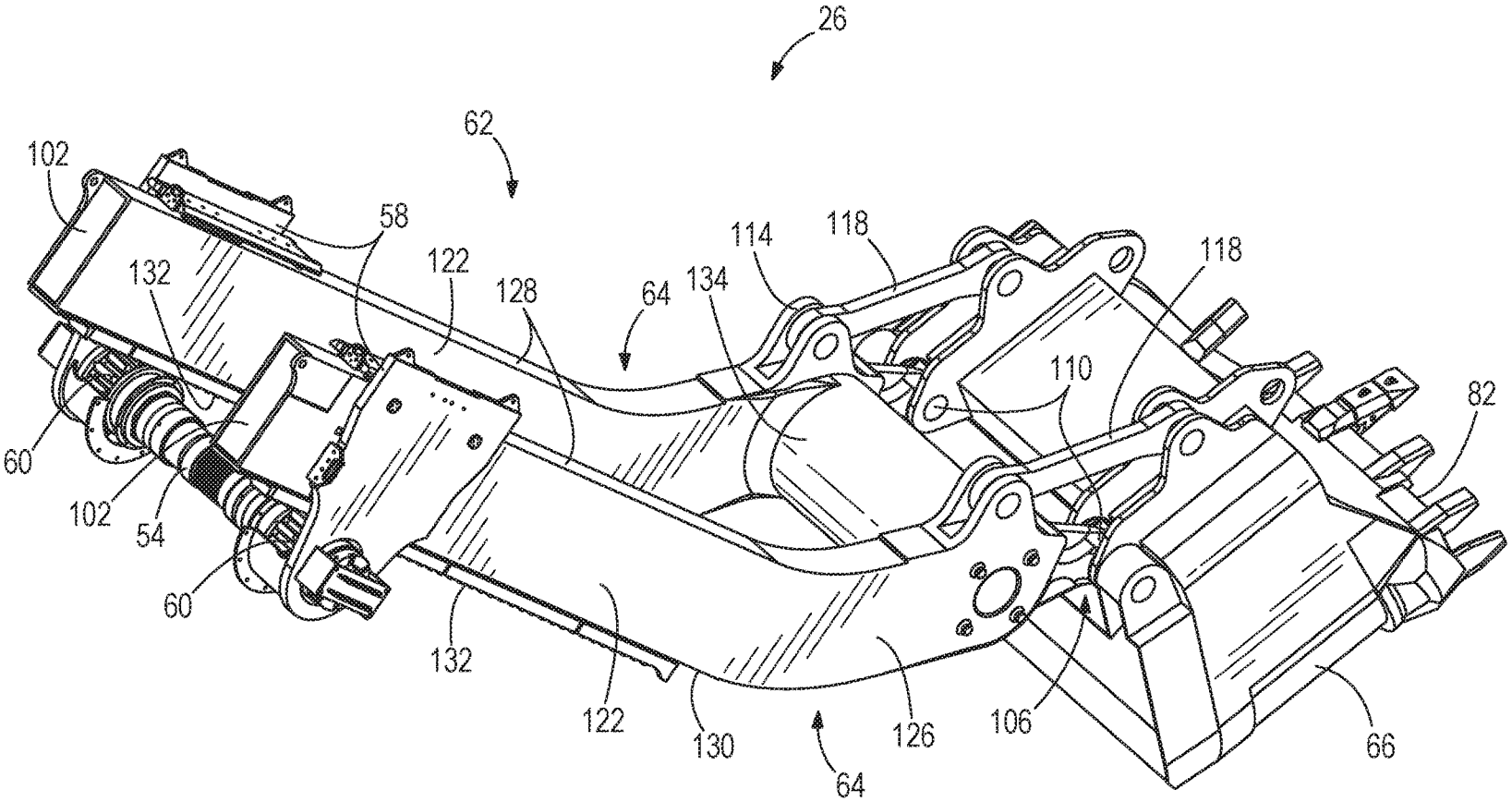
FIG. 5 is another perspective view of the digging assembly of FIG. 4.
Figure 6:
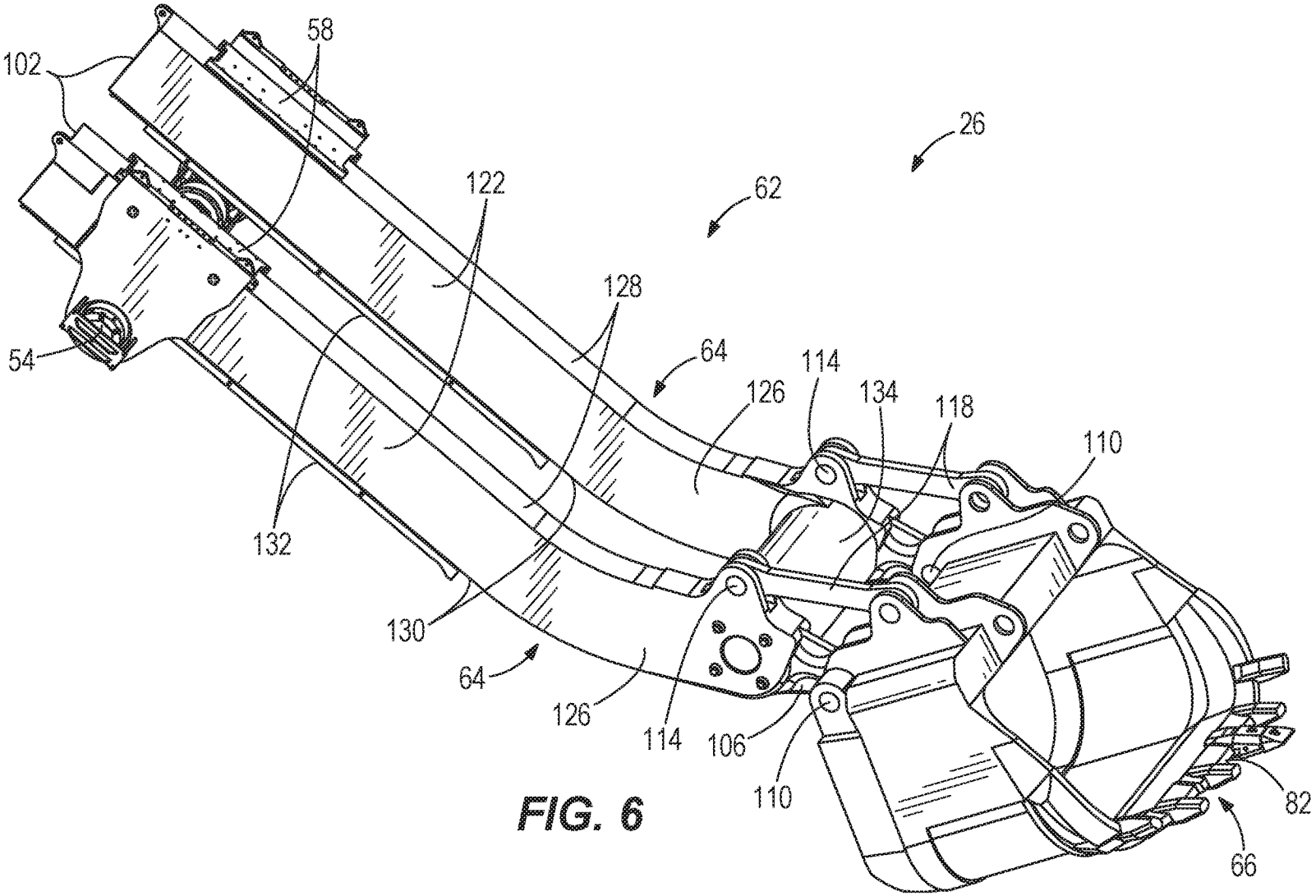
FIG. 6 is another perspective view of the digging assembly of FIG. 4.

Referring now to FIGS. 4-6, each arm 64 of the handle 62 includes a first portion 122 positioned adjacent the first end 102 and a second portion 126 positioned adjacent the second end 106. The first portion 122 of each arm 64 includes an upper surface 128 and a lower surface 130, and the rack 132 is positioned on the lower surface 130. The rack 132 engages the pinion gear 60 on each end of the shipper shaft 54, thereby forming a rack-and-pinion connection to extend and retract the handle 62 relative to the boom 22.

The handle 62 further includes a cross-member or torsion member 134 extending laterally between the arms 64. In the illustrated embodiment, the torsion member 134 extends between the second portions 126 of the arms 64. The torsion member 134 provides a reaction arm or support against twisting or torsional loads caused by loads distributed unevenly laterally between the arms 64 (for example, due to uneven loading along the digging edge 82 of the dipper 66).

Figure 7:
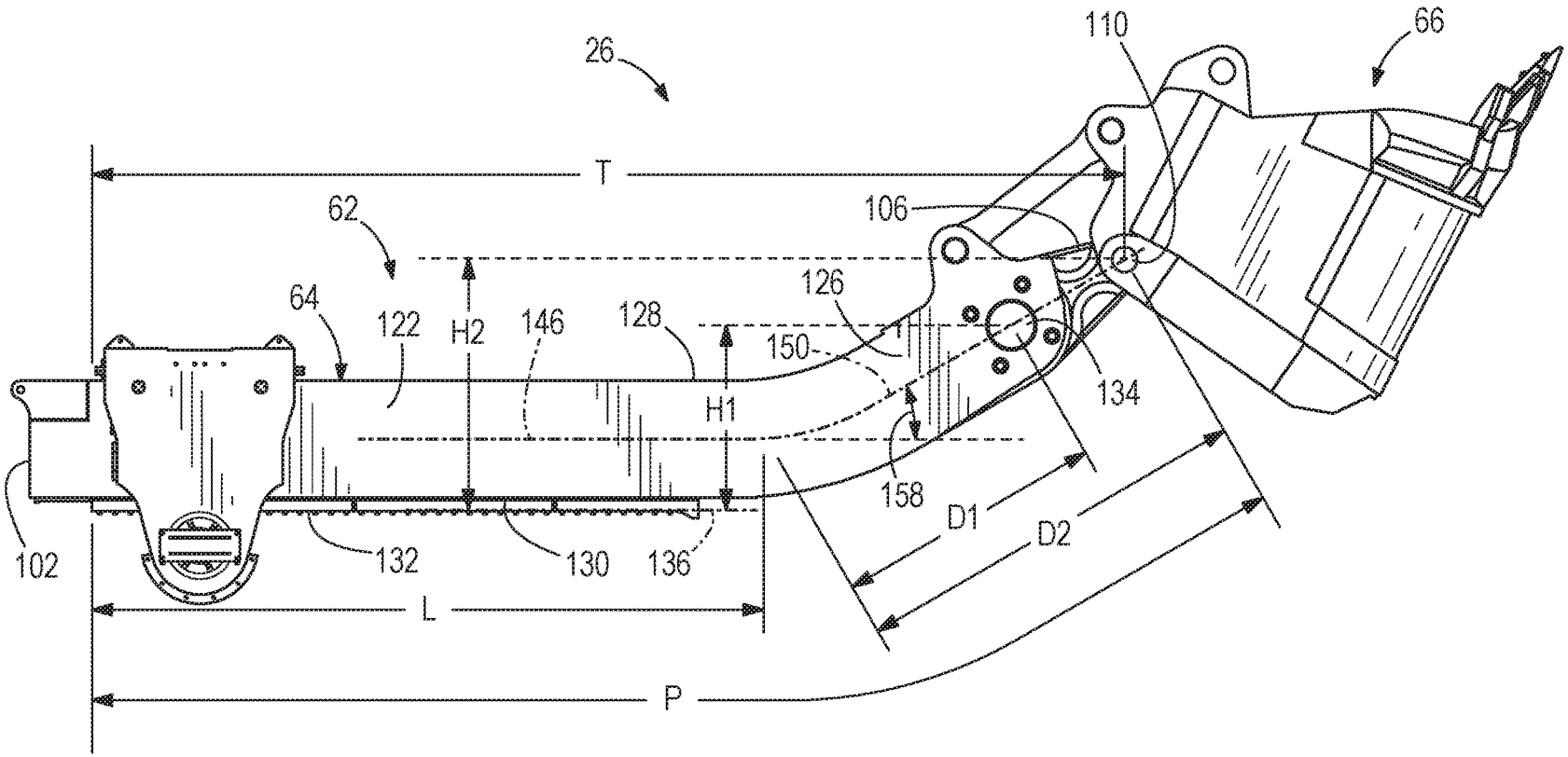
FIG. 7 is a side view of the digging assembly of FIG. 4.

As shown in FIG. 7, the first portion 122 of the handle 62 is substantially straight or linear. The rack 132 is positioned on the first portion 122, and the rack 132 extends along a rack line 136. The rack line 136 represents the line of action for the engagement between the pinion gear 60 (FIG. 5) and each arm 64, and approximately represents the locus of points about which the handle 62 may pivot relative to the boom 22 (FIG. 3). In one embodiment, the rack line 136 extends in a direction that is parallel to a lower surface 130 of the first portion 122. In the illustrated embodiment, the first portion 122 ends at a position at which the lower surface 130 of the handle 62 is no longer parallel to the rack line 136. That is, a portion of the lower surface 130 may be curved or may form an acute angle relative to the straight first portion 122. In the illustrated embodiment, the first portion 122 extends along a first axis 146 that is parallel to the rack line 136. The first axis 146 may represent a centerline between the upper surface 128 and the lower surface 130 of the first portion 122. The dipper 66 may be perpendicularly offset or spaced apart from the rack line 136. In other embodiments, the rack line may be defined by a first portion that is linear, and the rack may further include one or more non-linear or skewed or curved portion(s). Also, in other embodiments, the rack line may include a first portion that is non-linear and a second portion that is non-linear as well.

The second portion 126 is positioned proximate the end of the first portion 122 and extends along a second axis 150. In the illustrated embodiment, at least a section of the second portion 126 is linear. In the illustrated embodiment, the handle 62 may include an intermediate portion at a forward end of the first portion 122. That is, at least a portion of the second portion 126 is curved, and a transition section may extend between the first axis 146 and the linear section of the second axis 150 to form a continuous curve. The lower surface 130 of the intermediate portion may follow the same curvature as the transition section. In some embodiments, the second axis 150 is oriented parallel to the lower surface 130 of the linear section of the second portion 126. In some embodiments, the second axis 150 may be defined as a line extending between the center of the torsion member 134 and the end of the first portion 122. In other embodiments, the second axis 150 may be defined as a centerline between the upper surface 128 and the lower surface 130 of the second portion 126.

The second portion 126 is oriented at a handle angle 158 with respect to the first portion 122 and at an angle with respect to the rack line 136. In the illustrated embodiment, these angles are identical due to the first axis 146 being parallel to the rack line 136. In the illustrated embodiment, the handle angle 158 is defined between the first axis 146 and the second axis 150. The handle angle 158 is a non-zero angle. In some embodiments, the handle angle 158 is between approximately 10 degrees and approximately 60 degrees. In some embodiments, the handle angle 158 is between approximately 15 degrees and approximately 40 degrees. In some embodiments, the handle angle 158 is between approximately 15 degrees and approximately 35 degrees. In some embodiments, the handle angle 158 is between approximately 20 degrees and approximately 30 degrees. In some embodiments, the handle angle 158 is between approximately 20 degrees and approximately 23 degrees. In some embodiments, the handle angle 158 is approximately 20 degrees. In some embodiments, the handle angle 158 is at least approximately 30 degrees. In some embodiments, the handle angle 158 is approximately 30 degrees.

As shown in FIG. 7, in the illustrated embodiment, the torsion member 134 is aligned with the second axis 150 such that the second axis 150 intersects the center line of the torsion member 134. The lower coupling joint 110 is also substantially aligned with the second axis 150 such that the second axis 150 passes at least partially through the lower coupling joint 110. Positioning the lower coupling joint 110 to be substantially aligned with the second axis 150 may further improve the tuck back maneuverability and floor leveling performance of the shovel 10, as discussed in further detail below. In other embodiments, the torsion member 134 may not be aligned with the second axis 150, or the second axis 150 may intersect a portion of the torsion member 134 without passing through its center line. Similarly, in other embodiments the second axis 150 may not intersect the lower coupling joint 110.

A first portion length L extends between a rear end of the rack 132 and a forward end of the first portion 122. A handle axial length or base length T extends between a rear end of the rack 132 and the second end 106 of the handle 62, in a direction parallel to a linear portion of the rack line 136. Stated another way, the handle base length T represents a linear distance between the rear end of the rack 132 and the coupling joint supporting the dipper 66, projected onto a linear direction parallel to a linear portion of the rack line 136. In some embodiments, the base length T may be measured between the first end 102 and the second end 106 of the handle 62.

A torsion member length D1 is a distance between the end of the first portion 122 and the center of the torsion member 134. An end coupling length D2 is a distance extending along the second axis 150 between the end of the first portion 122 and the dipper coupling proximate the second end 106 of the handle 62 (e.g., the lower coupling 110 in FIG. 7). In the illustrated embodiments, the lengths D1 and D2 are measured along the second axis 150; in some embodiments, the lengths D1 and D2 may be measured with respect to a different reference feature (e.g., along the lower surface 130 of the arm 64, along the upper surface 128 of the arm 64, etc.). Also, in some embodiments (FIG. 13), the end coupling length D2 may be measured with respect to an upper coupling between the handle 62 and the dipper 66.

The handle 62 (particularly, each arm 64) also defines a profile. In the illustrated embodiment, the profile extends along a contour of the handle 62 between the first end 102 and the second end 106. The profile has a profile length P. In the illustrated embodiment, the profile length P is defined between a rear end of the rack 132 and the dipper coupling lug positioned adjacent the second end 106 of the handle 62 (e.g., the lower coupling joint 110 in FIG. 7). In other embodiments, the profile length may be defined with respect to a different reference point. In the illustrated embodiment, the profile length P defines an effective length of the handle 62 that is approximately equal to a distance between the first end of the rack 132 and the lower coupling joint 110, extending along the first axis 146, the second axis 150, as well as any transition section therebetween. As a result of the non-linear or curved or skewed geometry of the handle 62, the effective handle length is larger than an axial distance measured between the same two reference points (e.g., the base length T).

In some embodiments, the profile length P is between approximately 10% and approximately 30% greater than the base length T. In some embodiments, the profile length P is between approximately 10% and approximately 25% greater than the base length T. In some embodiments, the profile length P is approximately 15% greater than the base length T. In some embodiments, the profile length P is approximately 21% greater than the base length T.

A torsion member offset distance H1 defines a perpendicular offset distance of the center of the torsion member 134 to the rack line 136. A lower coupling offset distance H2 defines a perpendicular offset distance between the center of the lower coupling joint 110 to the rack line 136. In the illustrated embodiment, the offset distances H1 and H2 are measured along a direction perpendicular to the rack line 136. In other embodiments, the offset distances H1 and H2 may be measured relative to the first axis 146 instead of the rack line 136, or may be measured relative to a linear portion of the rack line 136.

In some embodiments, a ratio of the first portion length L to the handle base length T is less than or equal to approximately 90%. In some embodiments, a ratio of the first portion length L to the handle base length T is less than or equal to approximately 80%. In some embodiments, a ratio of the first portion length L to the handle base length T is between approximately 50% and approximately 90%. In some embodiments, a ratio of the first portion length L to the handle base length T is between approximately 60% and approximately 85%. In some embodiments, a ratio of the first portion length L to the handle base length T is between approximately 60% and approximately 75%. In some embodiments, a ratio of the first portion length L to the handle base length T is approximately 65%. In some embodiments, a ratio of the first portion length L to the handle base length T is approximately 80%.

In some embodiments, a ratio of the torsion member length D1 to the first portion length L is between approximately 5% and approximately 50%. In some embodiments, a ratio of the torsion member length D1 to the first portion length L is between approximately 7% and approximately 45%. In some embodiments, a ratio of the torsion member length D1 to the first portion length L is between approximately 10% and approximately 50%. In some embodiments, a ratio of the torsion member length D1 to the first portion length L is between approximately 20% and approximately 45%. In some embodiments, a ratio of the torsion member length D1 to the first portion length L is approximately 26%. In some embodiments, a ratio of the torsion member length D1 to the first portion length L is approximately 42%.

In some embodiments, a ratio of the lower coupling length D2 to the first portion length L is between approximately 5% and approximately 70%. In some embodiments, a ratio of the lower coupling length D2 to the first portion length L is between approximately 20% and approximately 65%. In some embodiments, a ratio of the lower coupling length D2 to the first portion length L is between approximately 20% and approximately 35%. In some embodiments, a ratio of the lower coupling length D2 to the first portion length L is between approximately 55% and approximately 65%. In some embodiments, a ratio of the lower coupling length D2 to the first portion length L is approximately 23%. In some embodiments, a ratio of the lower coupling length D2 to the first portion length L is approximately 61%.

In some embodiments, a ratio of the torsion member offset distance H1 to the first portion length L is between approximately 5% and approximately 40%. In some embodiments, a ratio of the torsion member offset distance H1 to the first portion length L is between approximately 10% and approximately 35%. In some embodiments, a ratio of the torsion member offset distance H1 to the first portion length L is between approximately 12% and approximately 30%. In some embodiments, a ratio of the torsion member offset distance H1 to the first portion length L is between approximately 15% and approximately 30%. In some embodiments, a ratio of the torsion member offset distance H1 to the first portion length L is approximately 20%. In some embodiments, a ratio of the torsion member offset distance H1 to the first portion length L is approximately 28%.

In some embodiments, a ratio of the lower coupling offset distance H2 to the first portion length L is between approximately 5% and approximately 60%. In some embodiments, a ratio of the lower coupling offset distance H2 to the first portion length L is between approximately 10% and approximately 55%. In some embodiments, a ratio of the lower coupling offset distance H2 to the first portion length L is between approximately 15% and approximately 50%. In some embodiments, a ratio of the lower coupling offset distance H2 to the first portion length L is between approximately 30% and approximately 50%. In some embodiments, a ratio of the lower coupling offset distance H2 to the first portion length L is at least approximately 30%. In some embodiments, a ratio of the lower coupling offset distance H2 to the first portion length L is approximately 12%. In some embodiments, a ratio of the lower coupling offset distance H2 to the first portion length L is approximately 38%.

Figure 8:
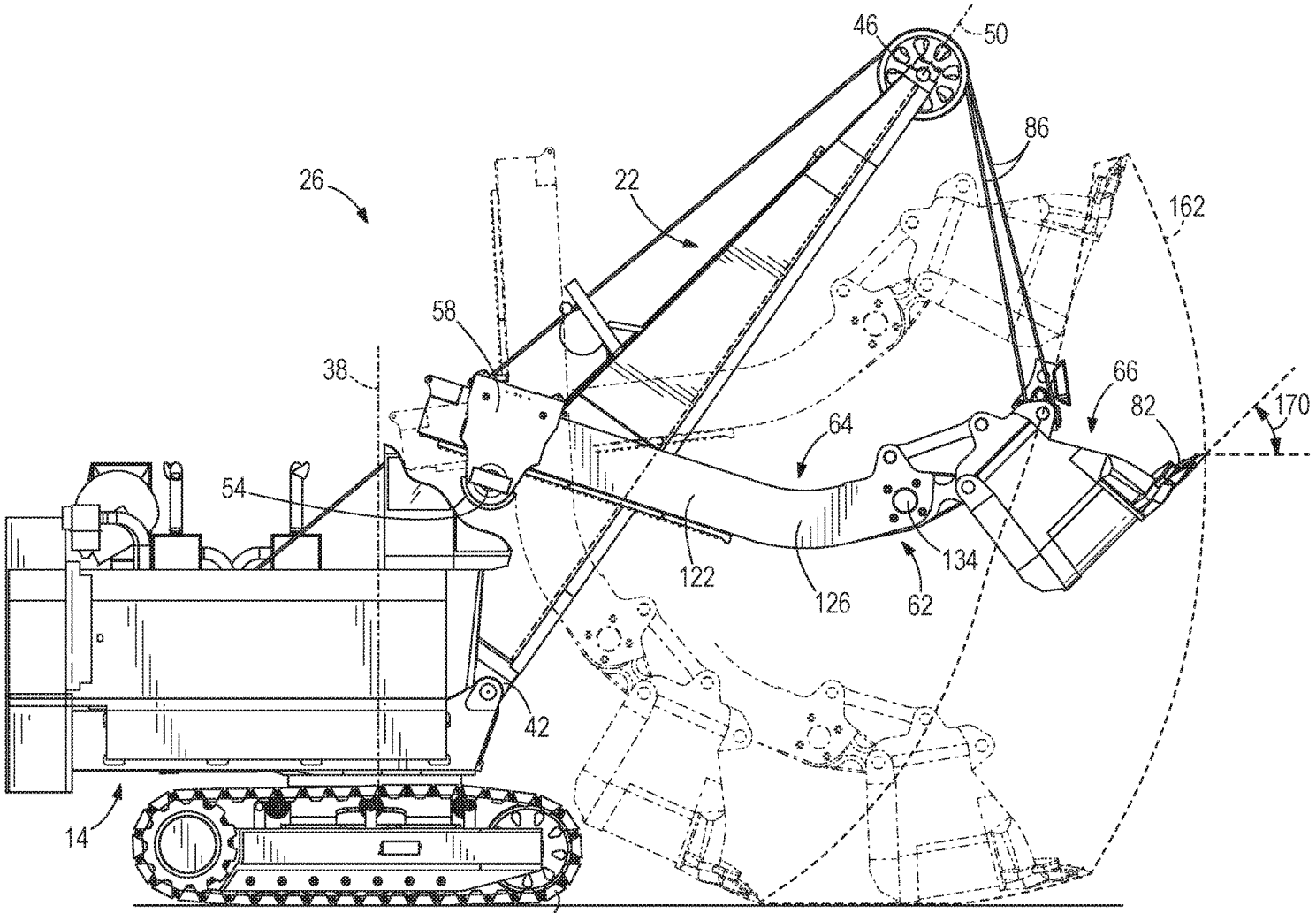
FIG. 8 is a side view of the rope shovel of FIG. 2 with a digging assembly in various positions.

FIG. 8 shows the digging assembly 26 in multiple positions and illustrates its digging profile 162. Among other things, forming the second portion 126 of the handle 62 at an angle relative to the first portion 122 provides improved maneuverability in the tuck-back position (that is, the position at which the dipper 66 is "tucked" closest to the base 14). The torsion member 134 is positioned further away from the boom 22 when the dipper 66 is brought in close to the base 14, and therefore the dipper 66 may be tucked close to the base 14 before the torsion member 134 contacts or interferes with the boom 22. Also, while the dipper 66 is tucked against the base 14, the dipper 66 may be raised vertically to a higher height than conventional shovels, permitting the operator to lift the dipper over loose rocks or boulders to move the dipper to the tucked position.

As a shovel progresses through a bank of material (not shown), a non-level floor may cause the entire shovel 10 to tilt upward or downward while digging, which may create an unsafe condition and increase stress on certain structural components. Relying on a separate dozer or grader to perform the levelling function is costly and time consuming. As a result, between dig cycles, an operator performs a leveling dig to make sure the shovel 10 remains level as it progresses. Since the second portion 126 of the handle 62

(i.e., the portion proximate the dipper 66) is oriented at an angle, the straight or linear first portion 122 may rotationally shift backwardly toward the shovel 10 while the dipper 66 is pushed forward. As a result, the handle 62 can rotate through a large angle while the dipper 66 is adjacent the ground, thereby providing an improved ability to "clean up" or level the floor surface positioned between the shovel 10 and the bank of material.

In some embodiments, the floor leveling range of the shovel 10 may be increased when the boom angle 52 is less than approximately 55 degrees (e.g., approximately 50 degrees or approximately 45 degrees). The floor leveling range may also be extended by increasing the length of the base 14 such that the lower end 42 of the boom 22 is moved forward (e.g., by between approximately 2 feet and approximately 6 feet). The floor leveling range could be improved by adjusting either or both of the boom axis angle and the position of the lower end 42 of the boom 22.

Furthermore, the handle 62 is able to position the dipper 66 such that the digging edge 82 is properly oriented with respect to the bank while the dipper 66 is raised through the bank. The teeth must be oriented to provide sufficient penetration of the bank while also being positioned to receive the dug material and sufficiently fill the dipper 66 in each pass. In one embodiment, the teeth of the digging edge 82 are oriented at a dig angle 170 (FIG. 8) of approximately 48 degrees relative to a horizontal plane when the digging edge 82 is at approximately the same height as the shipper shaft 54. The handle 62 also maintains the correct dipper orientation while the dipper 66 is emptied and provides sufficient clearance between the top edge of a haul truck 78 (FIGS. 2 and 3) and the opened dipper door 74 (FIG. 3). The dipper 66 is positioned to provide sufficient clearance for the dipper door 74 to swing open under gravity and allow full and efficient evacuation of the dipper 66. The front surface of the dipper 66 forms a dump angle 174 (FIG. 3) relative to a horizontal plane while the dipper 66 is emptied. In some embodiments, the dump angle 174 is greater than 35 degrees. In some embodiments, the dump angle is approximately 47 degrees.

The handle 62 provides optimum performance with respect to at least the aspects discussed above (i.e., tuck back maneuverability, flat floor levelling, digging edge orientation while digging, and dipper orientation while emptying), particularly in shovel configurations in which the shipper shaft 54 is positioned relatively close to the axis of rotation 38. The handle 62 provides this performance without the additional weight, complexity, or cost of auxiliary systems (e.g., hydraulic systems) that may be implemented to permit the dipper 66 to pivot independently of the handle 62.

In some embodiments (e.g., FIG. 12), the rack 132 extends along the first portion 122 and at least partially along the second portion 126. The rack 132 may extend along the curved or transition section of the handle 62. In this configuration, the portion of the rack 132 extending along the first portion 122 of the handle 62 may define the rack line 136. Extending the rack 132 along the transition section would provide more versatility in that it would enable the dipper 66 to be placed in positions that are typically not possible, and would provide increased clearance and vertical mobility when the dipper 66 is tucked. In addition, because the dipper 66 can be tucked further toward the shovel 10, the operable range of flat floor levelling is increased (e.g., the flat floor levelling range extends closer to the base 14 of the shovel 10).

Figure 9:
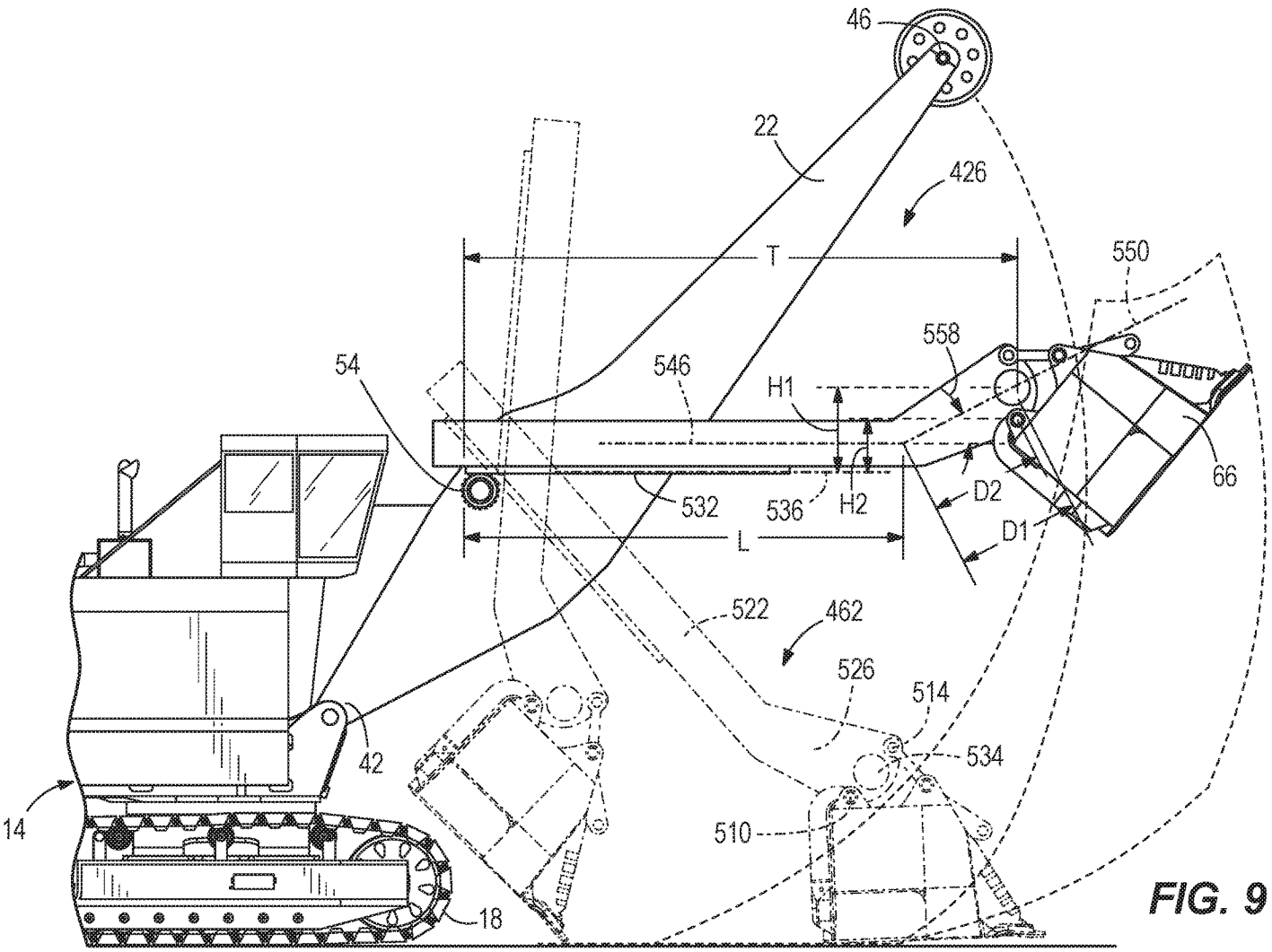
FIG. 9 is a side view of a rope shovel including a digging assembly according to another embodiment.

FIG. 9 illustrates a digging assembly 426 including a handle 462 according to another embodiment. The digging assembly 426 is similar to the digging assembly 26 described above with respect to FIGS. 2-8, and similar elements are identified with similar reference numbers, plus 400.

The handle 462 includes a second portion 526 that extends along a substantially linear second axis 550 without a curved transition section between the first portion 522 and the linear section of the second portion 526. Rather, the transition section includes a discrete bend or corner. As a result, the profile length of the handle 462 is substantially equal to the sum of the linear distances L and D2. In addition, in the illustrated embodiment, the torsion member 534 is positioned substantially between the dipper connections (i.e., the lower coupling 510 and the upper coupling 514). The torsion member 534 is offset even further from the first axis 546 and positioned substantially closer to a rear wall of the dipper 66 than the torsion member 134 of the embodiment shown in FIGS. 2-8 above. Furthermore, a portion of the dipper 66 is in-line with the rack line 536, and a significant portion of the dipper 66 is positioned on an opposite side of the rack line 536 from the lower coupling 510, the upper coupling 514, and the torsion member 534. In other embodiments, the relative length of the second portion 526 compared to the first portion 522 may be longer to increase the torsion member offset distance H1, to lower the coupling offset distance H2, or to ensure that less of the dipper 66 is in line with the rack line 536.

Figure 10:
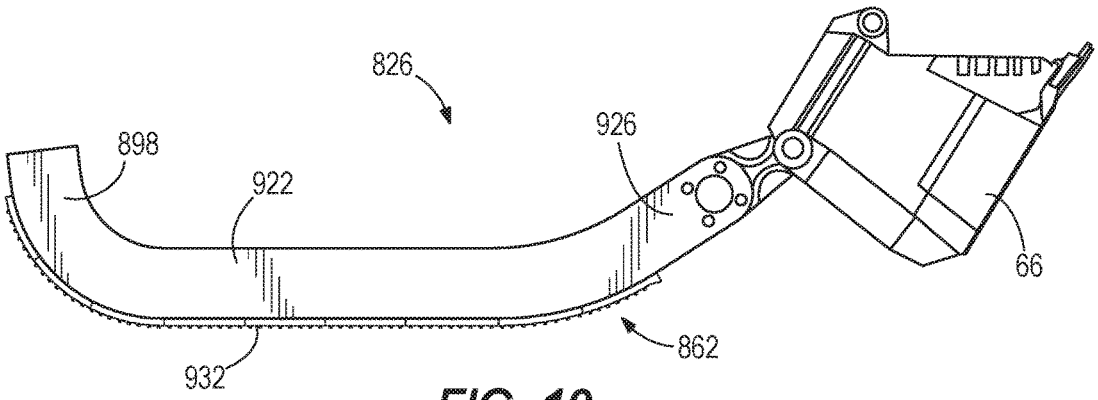
FIG. 10 is a side view of a digging assembly according to yet another embodiment.

FIG. 10 illustrates a digging assembly 826 including a handle 862 according to another embodiment. The digging assembly 826 is similar to the digging assembly 26 described above with respect to FIGS. 2-8, and similar elements are identified with similar reference numbers, plus 800.

A rear end of a handle 862 (i.e., the end positioned opposite the dipper 66) includes a rear curved section 898. In the illustrated embodiments, the rack 932 extends along the rear curved section 898. In some embodiments, the rear curved section 898 may have the same curvature as the transition section between the first portion 922 and the second portion 926 of the handle 862. In other embodiments, the curvature of the rear curved section 898 may be different from the curvature of the transition section.

Figure 11:
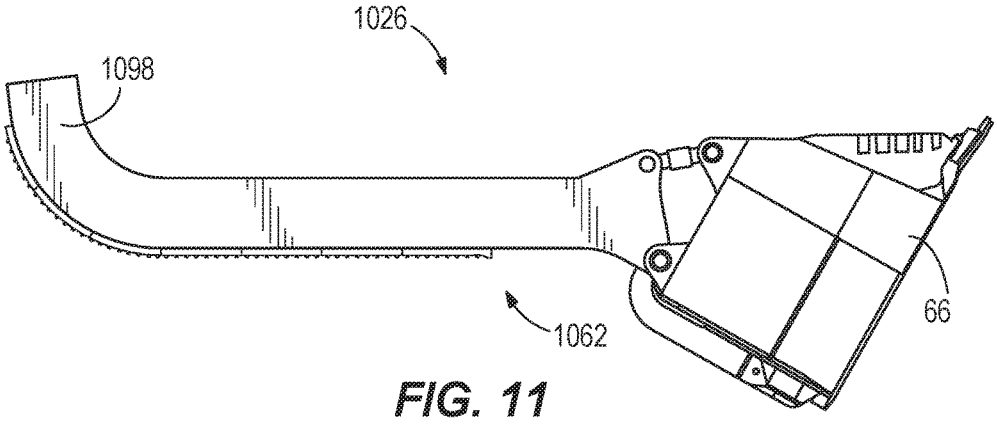
FIG. 11 is a side view of a digging assembly according to still another embodiment.

The rear curved section 898 increases a cutting force applied by the digging edge when the dipper 66 is positioned at a base or toe of the bank (not shown), improving penetration of the bank. In some embodiments, the crowd motion is substantially in-line with the digging edge of the dipper 66, thereby assisting the hoist force. As shown in FIG. 10, in some embodiments the handle includes a curved section proximate each end of the handle. FIG. 11 illustrates another embodiment in which a rear end of the handle 1062 includes a significantly curved section 1098 while the end of the handle 1062 proximate the dipper 66 includes only a slight curvature, if any.

Figure 12:
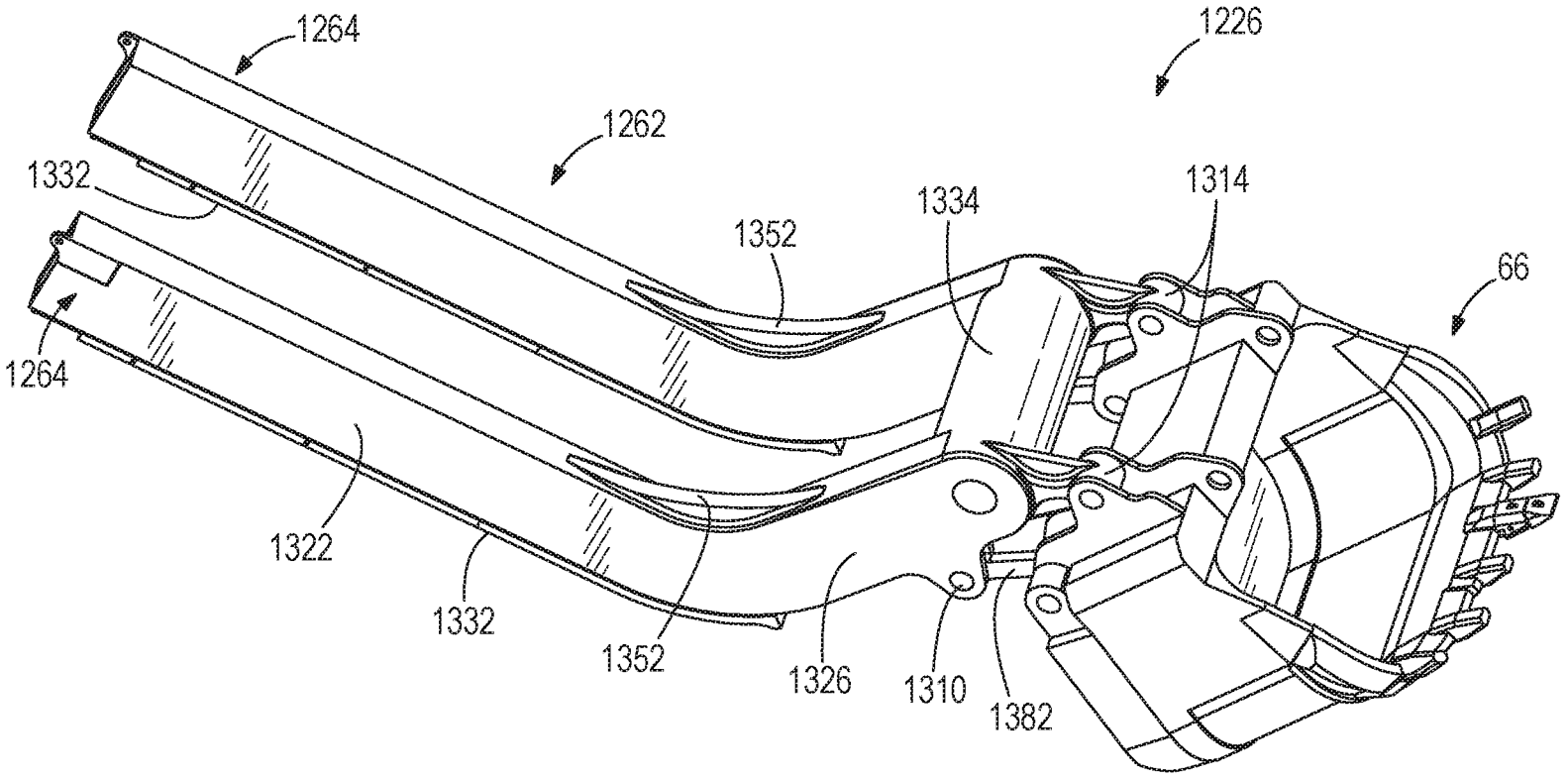
FIG. 12 is a perspective view of a digging assembly according to yet another embodiment.
Figure 13:
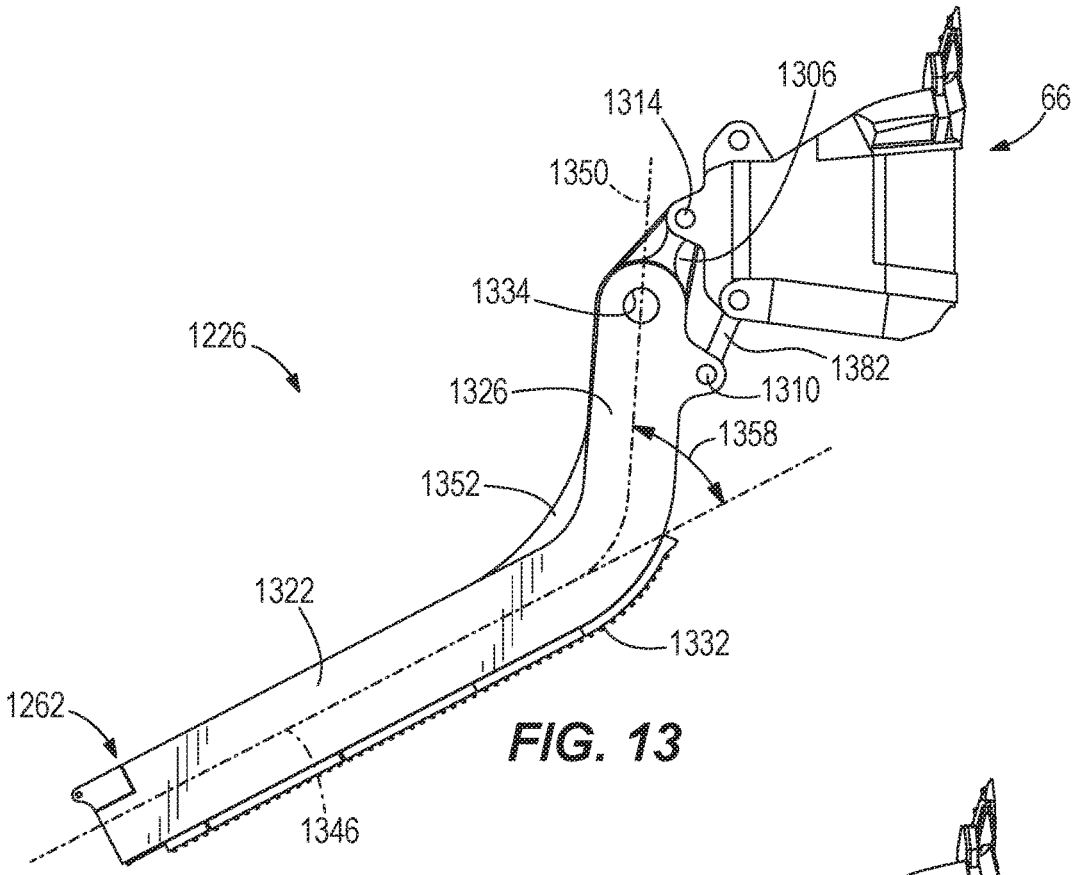
FIG. 13 is a side view of the digging assembly of FIG. 12.

FIGS. 12 and 13 illustrate a digging assembly 1226 according to yet another embodiment. The digging assembly 1226 is similar to the digging assembly 26 described above with respect to FIGS. 2-8, and similar elements are identified with similar reference numbers, plus 1200.

Figure 14:
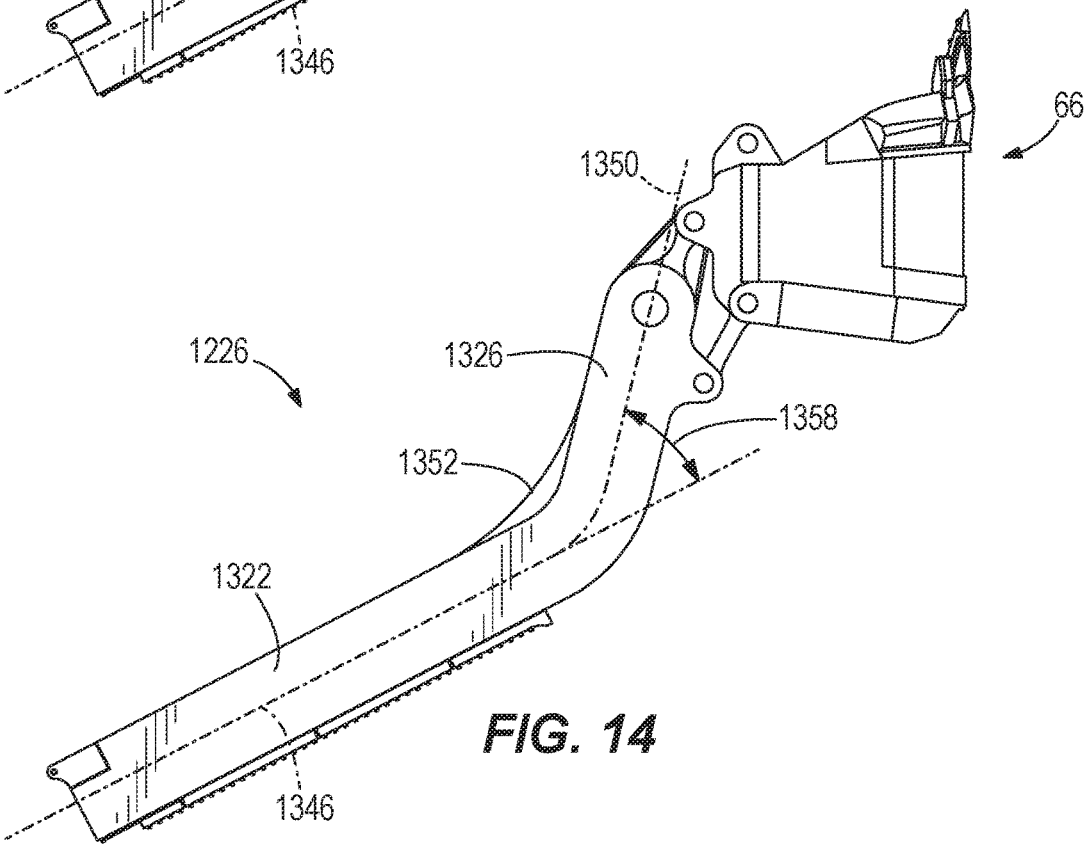
FIG. 14 is a side view of a digging assembly according to still another embodiment.

As shown in FIG. 13, the digging assembly 1226 includes a handle 1262 having a second portion 1326 oriented at an angle 1358 relative to a first portion 1322. In the illustrated embodiment, the first portion 1322 extends along a first axis 1346 and the second portion 1326 extends along a second axis 1350, and a torsion box 1334 is aligned with the second axis 1350. In some embodiments, the handle angle 1358 is between approximately 20 degrees and approximately 70 degrees. In some embodiments, the handle angle 1358 is between approximately 30 degrees and approximately 70 degrees. In some embodiments, the handle angle 1358 is between approximately 35 degrees and approximately 65 degrees. In some embodiments, the handle angle 1358 is between approximately 40 degrees and approximately 60 degrees. In some embodiments, the handle angle 1358 is between approximately 45 degrees and approximately 60 degrees. In the illustrated embodiment, the handle angle 1358 is approximately 58 degrees. In another embodiment (FIG. 14), the handle angle 1358 is approximately 49 degrees. In some embodiments, the handle angle 1358 is at least approximately 40 degrees.

In the illustrated embodiment, the torsion box 1334 is positioned adjacent the second end 1306 of the handle 1262, and the upper coupling joint 1314 and the lower coupling joint 1310 are positioned on the same side of the second axis 1350. That is, the second axis 1350 does not extend between the coupling joints 1310, 1314. In addition, the upper coupling joint 1314 is positioned adjacent an end 1306 of the handle 1262 and is directly coupled to the dipper 66, while the lower coupling joint 1310 is positioned on a lower surface of the handle 1262 and is coupled to the dipper 66 by a brace member 1382. In some embodiments, the length of the brace member 1382 may be adjusted to provide a desired attack angle based on dig characteristics.

Figure 15:
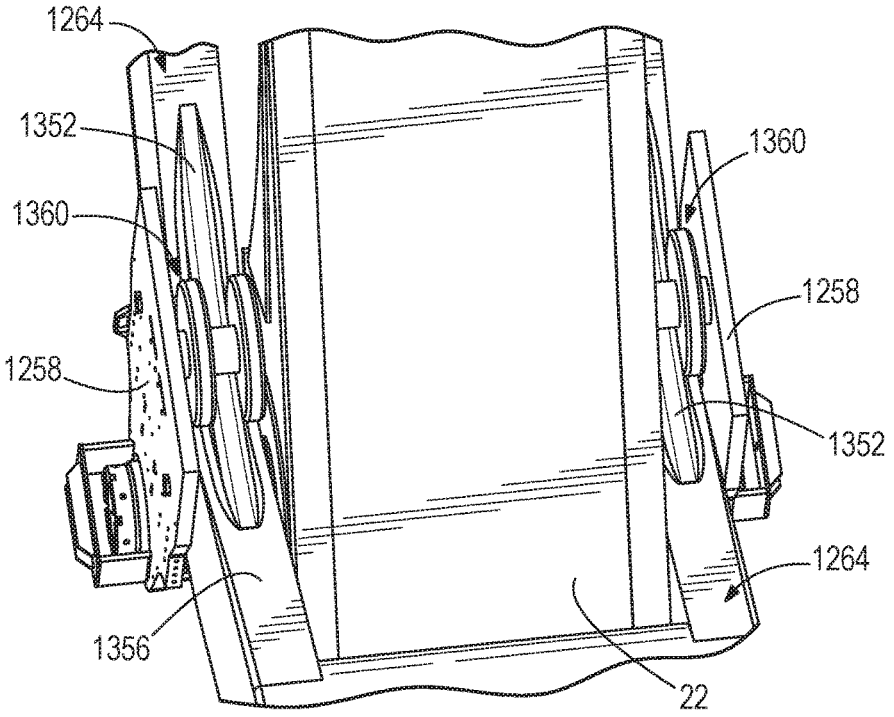
FIG. 15 is a perspective view of a portion of the digging assembly handle of FIG. 12 as well as a saddle block and a portion of a boom.
Figure 16:
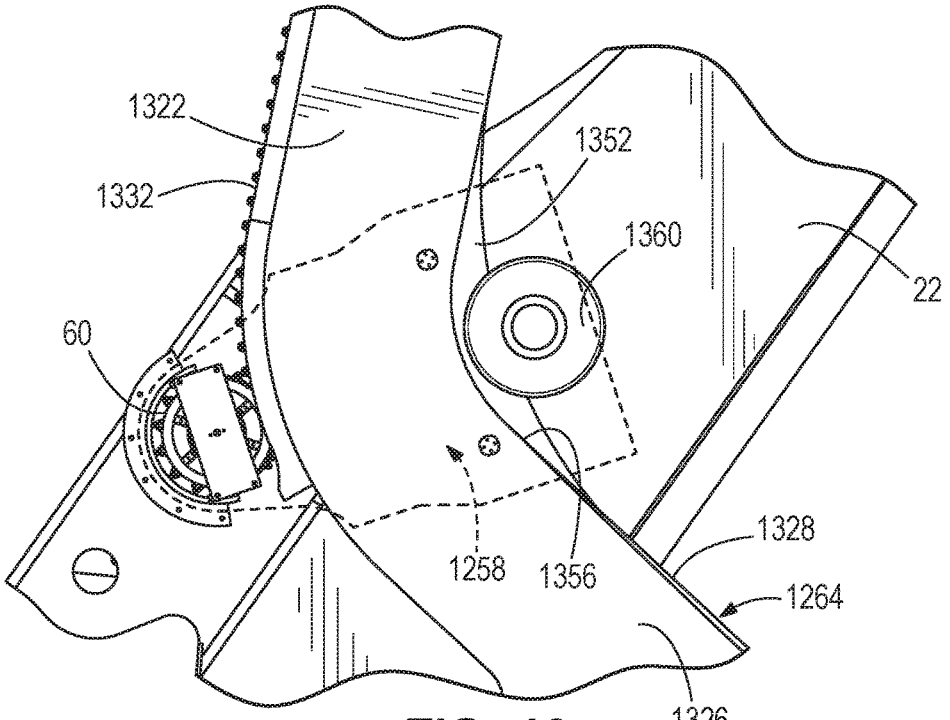
FIG. 16 is a side view of the saddle block, the boom, and the handle of FIG. 15.

In the illustrated embodiment, a rack 1332 extends along a substantial portion of first portion 1322 and partially along a transition section between the first portion 1322 and the second portion 1326. Also, as shown in FIGS. 15 and 16, each arm 1264 of the handle 1262 includes a rib 1352 extending along an inner surface 1356 of the transition section between the first portion 1322 and the second portion 1326. A guide 1360 is coupled to an inner portion of each saddle block 1258 and engages an upper surface 1328 of the handle 1262. In the illustrated embodiment, the guide 1360 includes a pair of rollers, and the rib 1352 is positioned between the rollers as the pinion gear 60 (FIG. 16) engages the curved portion of the rack 1332. The rib 1352 may provide additional strength to reduce stress in the curved portion of the handle 1262, and the guide 1360 maintains the engagement between the rack 1332 and the pinion gear 60.

Figure 17:
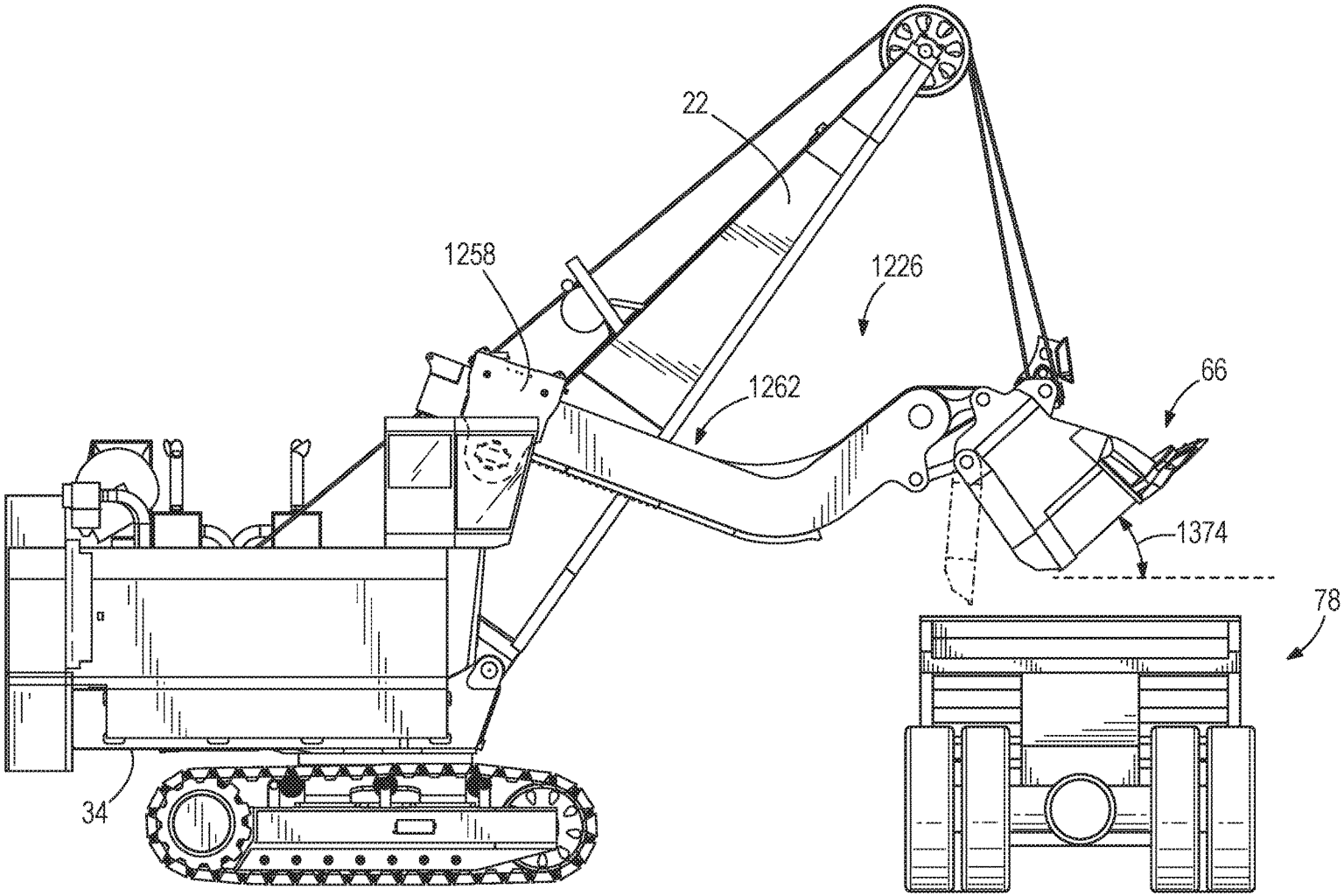
FIG. 17 is a side view of a haul vehicle and a shovel including the digging assembly of FIG. 12.
Figure 18:
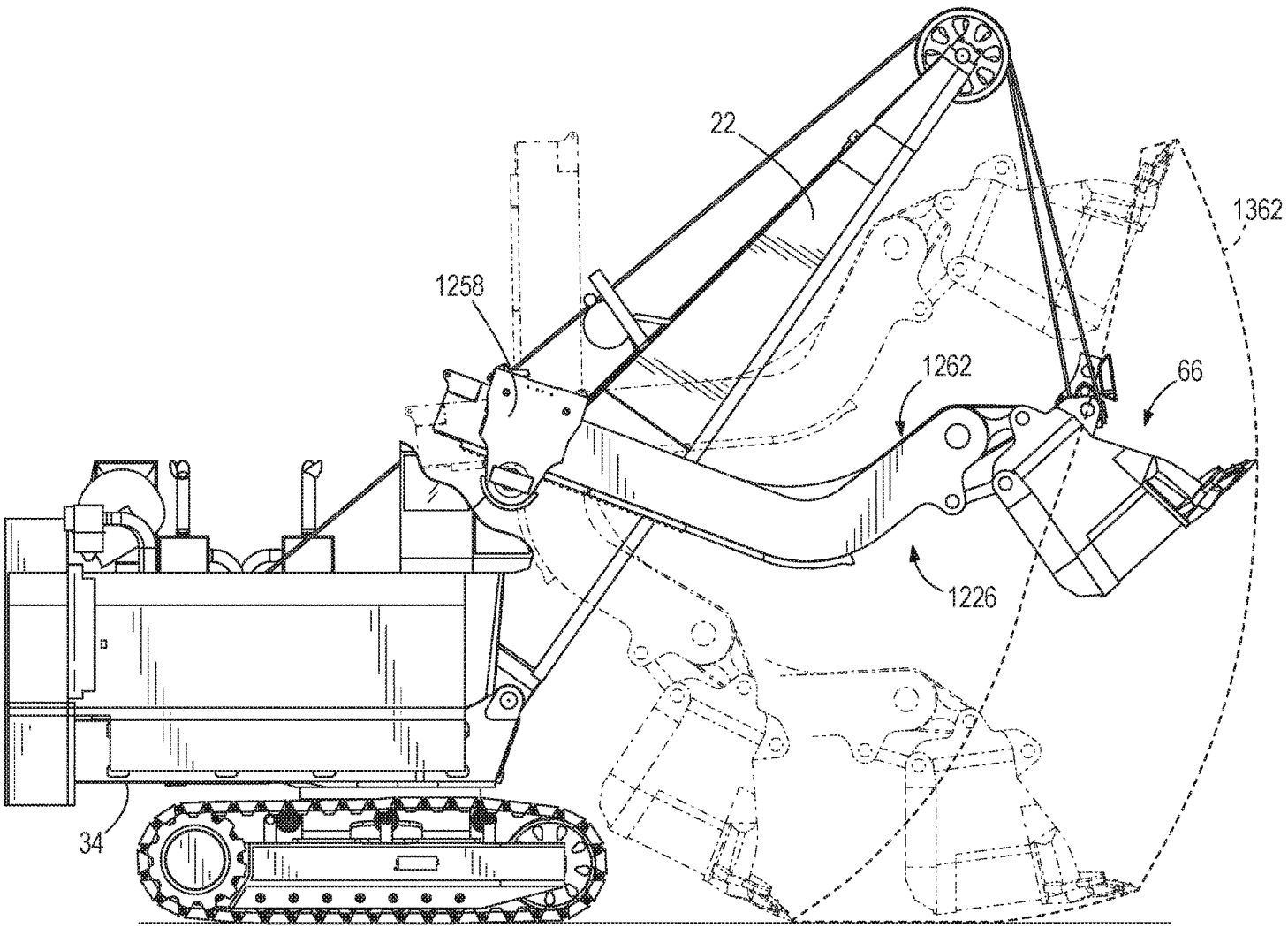
FIG. 18 is a side view of the shovel of FIG. 17 with the digging assembly in various positions.
Figure 19:
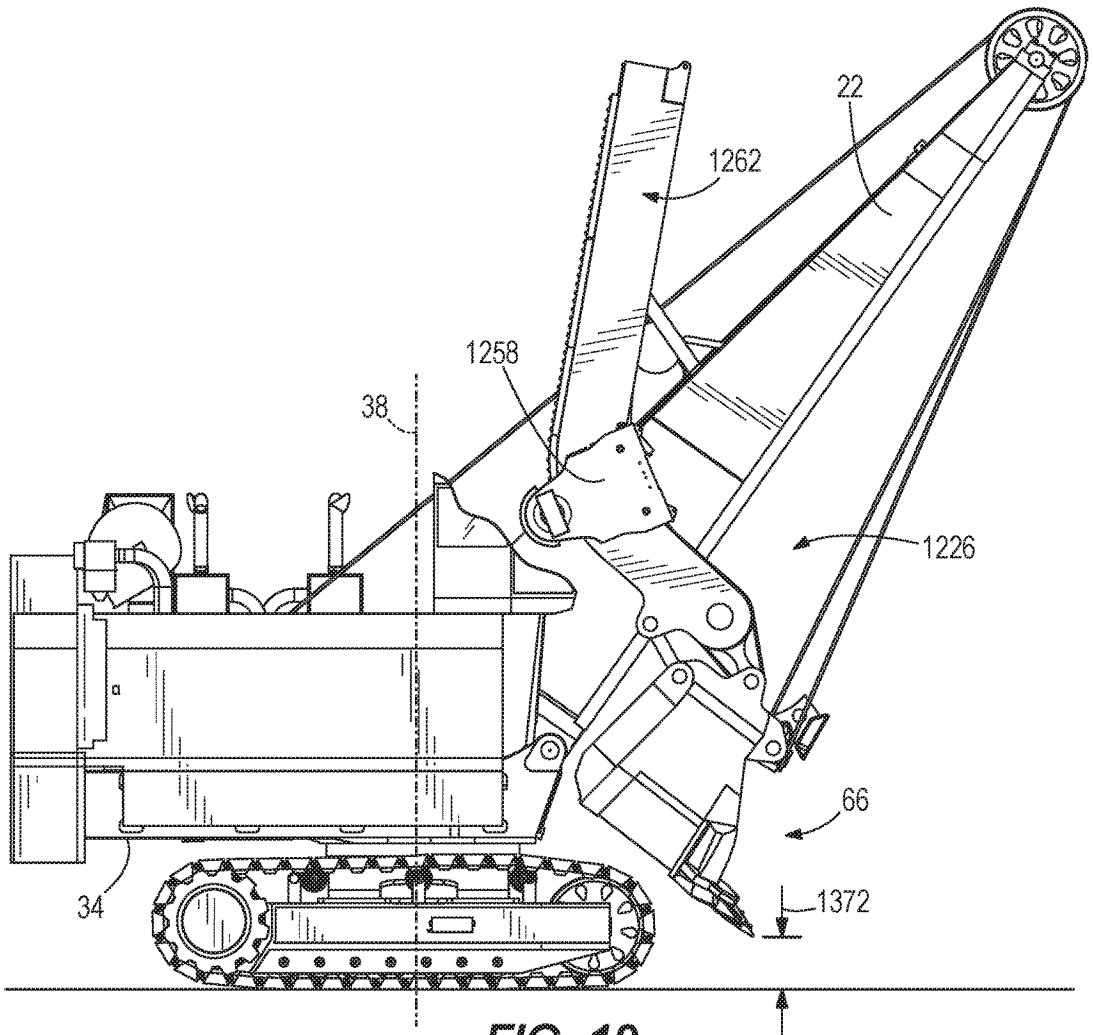
FIG. 19 is a side view of the shovel of FIG. 17 with the digging assembly in a tucked position.

As shown in FIGS. 17-19, the digging assembly 1226 maintains a suitable dump angle 1374 (FIG. 17) and dump clearance with respect to haul vehicles 78. The digging assembly 1226 also provides a dig envelope 1362 (FIG. 18), dig path, and flat floor range that are comparable to rope shovels having more sophisticated bucket pivot mechanisms, but is significantly less complex. The digging assembly 1226 also improves tuckability and maneuverability while the dipper 66 is tucked, providing significant clearance 1372 (FIG. 19) with respect to the ground.

Although certain embodiments have been described in detail, variations and modifications exist within the scope and spirit of one or more independent aspects as described. Various features and advantages are set forth in the following claims.

We claim:

1. A mining machine comprising:

a frame;

a boom including a first end and a second end opposite the first end, the first end coupled to the frame;

a pivot element positioned between the first end and the second end of the boom;

a hoist rope including a portion extending over the second end of the boom;

an elongated member supported by the pivot element for movement relative to the boom, the member including, a first end, a second end, a pair of arms oriented parallel to one another, each arm including a first portion proximate the first end of the member and a second portion positioned between the first portion and the second end of the member, at least a portion of the second portion oriented at an angle relative to the first portion, the first portion defining a first centerline extending between the first end and the second portion, a first lug and a second lug spaced apart from the first lug, the first lug and the second lug positioned adjacent the second end and coupled to one of the arms, both the first lug and the second lug being positioned on the same side of the first centerline, and a cross-member extending laterally between the second portions of the arms, the cross-member offset from the first portion such that a centerline of the first portion is spaced apart from the cross-member; and a digging attachment coupled to the first lug and the second lug and being supported by the hoist rope.

2. The mining machine of claim 1, wherein the pivot element includes a shipper shaft extending through the boom and at least one pinion gear positioned proximate one side of the boom, wherein at least one of the pair of arms including a lower surface and a rack positioned on the lower surface, the rack engaging the pinion gear, the rack extending along a rack line, wherein the first portion extends in a direction parallel to the rack line.

3. The mining machine of claim 2, wherein the lower surface extends between the rack and the second end of the member, the lower surface of the first portion oriented parallel to the rack line, the lower surface of the second portion extending at an angle away from the rack line.

4. The mining machine of claim 2, wherein the rack line is offset from the digging attachment such that no portion of the digging attachment is inline with the rack line.

5. The mining machine of claim 1, wherein the angle between the second portion and the first portion is between approximately 30 degrees and approximately 70 degrees.

6. The mining machine of claim 5, wherein the angle between the second portion and the first portion is between approximately 40 degrees and approximately 60 degrees.

7. The mining machine of claim 1, wherein the boom is positioned between the pair of arms, further comprising a pair of saddle blocks for supporting the arms, each saddle block including a rolling element engaging an upper surface of a respective arm.

8. A digging assembly for a rope shovel, the rope shovel including a boom having a first end and a second end, a pivot element positioned between the first end and the second end of the boom, and a hoist rope extending over the second end of the boom, the digging assembly comprising:

a dipper configured to be supported by the hoist rope; and an elongated handle configured to be supported by the pivot element for movement relative to the boom, the handle including a first end, a second end, a pair of arms oriented parallel to one another, each arm including a first portion proximate the first end of the handle and a second portion positioned between the first portion and the second end of the handle, at least a portion of the second portion oriented at an acute angle relative to the first portion, the first portion defining a first centerline extending between the first end of the handle and the second portion, a first coupling and a second coupling spaced apart from the first coupling, the first coupling and the second coupling positioned adjacent the second end and coupled to one of the arms, the first coupling and the second coupling coupled to the dipper, both the first coupling and the second coupling being positioned on the same side of the first centerline, and a cross-member extending laterally between the second portions of the arms, the cross-member offset from the first portion such that the first centerline is spaced apart from the cross-member.

9. The digging assembly of claim 8, wherein the angle between the second portion and the first portion is between approximately 30 degrees and approximately 70 degrees.

10. The digging assembly of claim 9, wherein the angle between the second portion and the first portion is between approximately 40 degrees and approximately 60 degrees.

11. The digging assembly of claim 8, wherein the handle further includes a pair of ribs, each rib extending along a portion of an upper surface of one of the arms.

12. The digging assembly of claim 8, wherein at least one of the pair of arms including a lower surface and a rack positioned on the lower surface, the rack configured to engage the pivot element and extending along a rack line, wherein the first portion extends along a first axis oriented parallel to the rack line.

13. The digging assembly of claim 12, wherein the lower surface extends between the first end and the second end of the handle, the lower surface of the first portion parallel to the rack line, the lower surface of the second portion extending at an angle away from the rack line.

14. The digging assembly of claim 12, wherein the rack line is offset from the dipper such that no portion of the dipper is inline with the rack line.

15. The digging assembly of claim 8, wherein the first portion extends along a first axis and the second portion extends along a second axis, the first axis defined by the centerline of the first portion and the second axis defined by a centerline of the second portion.

16. The digging assembly of claim 8, wherein the second portion includes a curved section and a linear section, the curved section positioned between the first portion and the linear section.

17. The digging assembly of claim 8, wherein the second portion extends along a second axis, the second axis intersecting the cross-member.

18. The digging assembly of claim 8, wherein the first portion extends along a first axis and the second portion extends along a second axis, wherein the first coupling and the second coupling are positioned on the same side of the second axis.

19. A digging assembly for a rope shovel, the rope shovel including a boom having a first end and a second end, a pivot element positioned between the first end and the second end of the boom, and a hoist rope extending over the second end of the boom, the digging assembly comprising:

a dipper configured to be supported by the hoist rope; and an elongated handle configured to be supported by the pivot element for movement relative to the boom, the handle including a first end, a second end coupled to the dipper, and a pair of arms oriented parallel to one another, each arm including a first portion proximate the first end of the handle and a second portion positioned between the first portion and the second end of the handle, at least a portion of the second portion oriented at an acute angle relative to the first portion, the member further including a cross-member extending laterally between the second portions of the arms, the cross-member offset from the first portion such that a centerline of the first portion is spaced apart from the cross-member, wherein at least one of the pair of arms including a lower surface and a rack positioned on the lower surface, the rack configured to engage the pivot element and extending along a rack line, wherein the first portion extends along a first axis oriented parallel to the rack line, wherein the rack line is offset from the dipper such that no portion of the dipper is inline with the rack line.

20. The digging assembly of claim 19, wherein the angle between the second portion and the first portion is between approximately 30 degrees and approximately 70 degrees.

21. The digging assembly of claim 20, wherein the angle between the second portion and the first portion is between approximately 40 degrees and approximately 60 degrees.

22. The digging assembly of claim 19, wherein the handle further includes a pair of ribs, each rib extending along a portion of an upper surface of one of the arms.

23. The digging assembly of claim 19, wherein the lower surface extends between the first end and the second end of the handle, the lower surface of the first portion parallel to the rack line, the lower surface of the second portion extending at an angle away from the rack line.

24. The digging assembly of claim 19, wherein the second portion includes a curved section and a linear section, the curved section positioned between the first portion and the linear section.

25. The digging assembly of claim 19, wherein the second portion extends along a second axis, the second axis intersecting the cross-member.

26. The digging assembly of claim 19, wherein the first portion extends along a first axis and the second portion extends along a second axis, wherein the dipper is coupled to the handle at a first coupling and a second coupling spaced apart from the first coupling, wherein the first coupling and the second coupling are positioned on the same side of the second axis.

* * * * *